United States Patent [19]

Mayer

[11] 4,395,886

[45] Aug. 2, 1983

[54] REFRIGERANT CHARGE MONITOR AND METHOD FOR TRANSPORT REFRIGERATION SYSTEM

[75] Inventor: Donald K. Mayer, Bloomington, Minn.

[73] Assignee: Thermo King Corporation, Minneapolis, Minn.

[21] Appl. No.: 318,232

[22] Filed: Nov. 4, 1981

[51] Int. Cl.[3] ..... F25B 13/00

[52] U.S. Cl. ..... 62/160; 62/209; 62/227

[58] Field of Search ..... 62/208, 209, 227, 228 R, 62/126, 160; 417/19, 32

[56] References Cited

U.S. PATENT DOCUMENTS

| | | | |
|---|---|---|---|
| 3,131,549 | 5/1964 | Rhea | 62/228 |
| 3,159,981 | 12/1964 | Huskey | 62/140 X |
| 3,348,607 | 10/1967 | Cootey | 62/208 X |
| 4,137,725 | 2/1979 | Martin | 62/160 |
| 4,265,091 | 5/1981 | Kobayashi | 62/228 R |
| 4,327,558 | 5/1982 | Howland et al. | 62/160 |

*Primary Examiner*—William E. Wayner

*Attorney, Agent, or Firm*—E. C. Arenz

[57] ABSTRACT

In a transport refrigeration system of the type adapted to provide either heating or cooling, loss of refrigerant is detected by first and second sensors 58 and 60 located upstream and downstream, respectively, of the expansion device 34, and with the downstream sensor 60 also being downstream of the location at which hot gas is injected from line 56 to pass to the refrigerant coil 40 in a heating mode of operation. The arrangement includes means for both determining the mode of system operation, either heating or cooling, and comparing the differential temperatures sensed for determining the departures from ranges of temperatures normally expected with an adequate charge of refrigerant.

7 Claims, 2 Drawing Figures

REFRIGERANT CHARGE MONITOR AND METHOD FOR TRANSPORT REFRIGERATION SYSTEM

BACKGROUND OF THE INVENTION

1. Field of the Invention

The invention pertains generally to the art of transport refrigeration systems and in particular to an arrangement for detecting a loss of refrigerant charge in such a system.

Transport refrigeration units are used to keep the served space in which commodities are shipped at or close to a given temperature through the use of a refrigeration system which is adapted to provide either heating or cooling since different kinds of commodities may require vastly different temperatures. Frequently, in the shipment of such commodities, the refrigerated trailer or other served space may be unattended for periods of up to a number of days, such as when a truck stops overnight at a truck stop, or a trailer is left at a freight terminal over a weekend, or a "piggyback" trailer spends several days unattended on the railroad flat car of a cross-country train. If there is a loss of refrigerant due to system leakage while the refrigeration unit is unattended, the continued operation of the compressor for more than a limited period, such as a half hour to one hour may result in compressor failure. The failure, of course, is due to loss of oil in the compressor rather than the loss of the refrigerant itself.

While in some applications a suction line low-pressure cut-out switch can protect against compressor destruction through loss of refrigerant charge, such a safeguard is not practical if the system must operate throughout a wide range of evaporator temperatures and suction pressures, as is the case with transport refrigeration units.

Accordingly, it is considered desirable to have some arrangement for determining that a given refrigerant charge has been lost in a transport refrigeration system and to provide means for generating at least a warning signal in accordance with a predetermined loss.

It is the aim of this invention to provide such an arrangement for a transport refrigeration system.

SUMMARY OF THE INVENTION

In accordance with the invention, a transport refrigeration system of the type adapted to operate in either heating or cooling mode and including an expansion device located upstream from both the refrigerant coil and the location at which the hot refrigerant gas is introduced into a line to feed the refrigerant coil in a heating operation, is provided with an arrangement for sensing the temperatures upstream of the expansion device, and also sensing temperatures downstream of the expansion device and at a location also downstream from where hot refrigerant is introduced to feed the refrigerant coil for heating, but upstream of the refrigerant coil, and with the arrangement including means responsive to the operating mode of the system and the differentials in temperature sensed at the upstream and downstream location for at least signalling the desirability of a system shut-down in accordance with a departure in the differential temperatures of the two sensors from predetermined ranges of differential temperatures normally expected in accordance with the operating mode of the system.

DESCRIPTION OF THE PREFERRED EMBODIMENT

Figure 1:
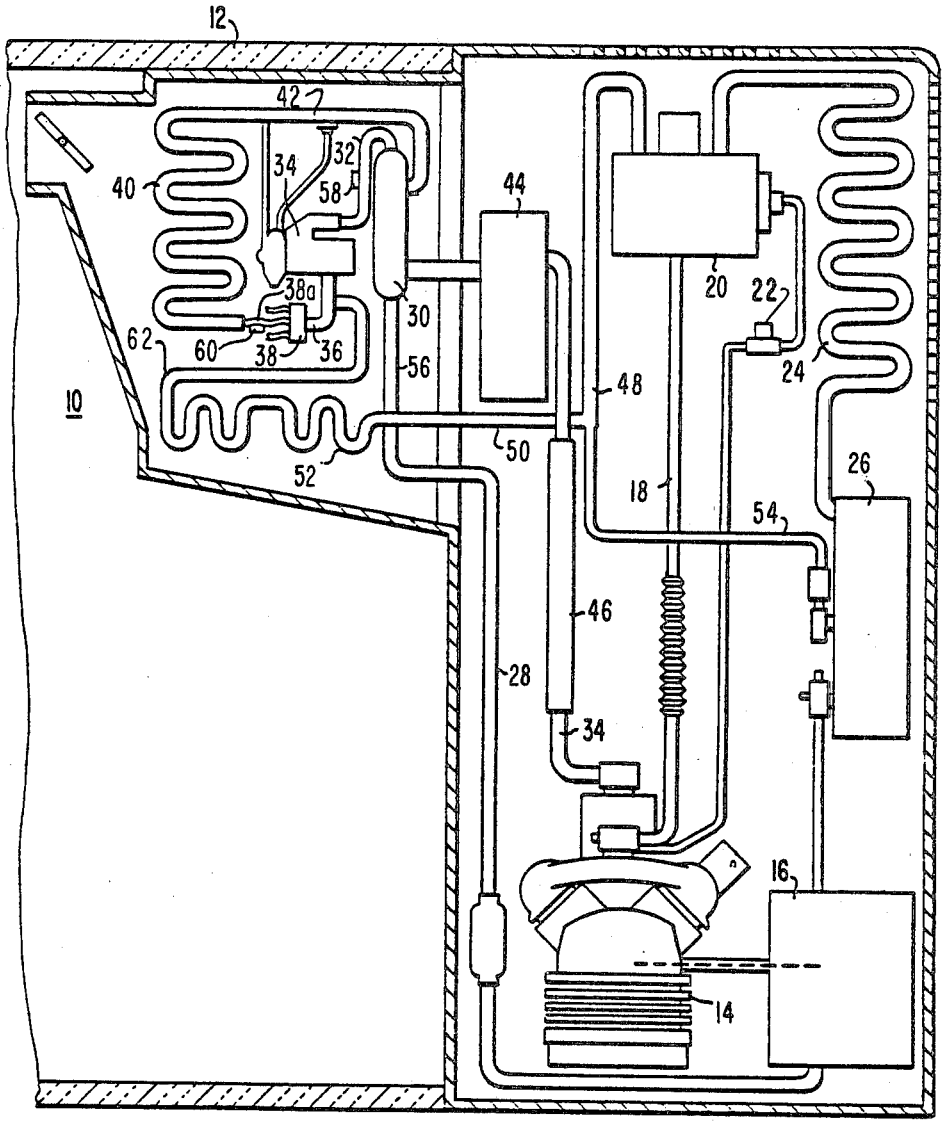
FIG. 1 is a schematic view of the main parts of a transport refrigeration system of the type to which the invention is applied for example.

Referring to FIG. 1, a transport refrigeration system of basically conventional parts is provided to serve the space 10 within an insulated trailer 12 or the like. Most of the main parts are shown in schematic form since the system shown is considered conventional for purposes of this application and has been available from the assignee of this application for a number of years.

A refrigerant compressor 14 is driven by a prime mover 16 such as an internal combustion engine or electric motor.

The compressor 14 discharges hot gas through discharge line 18 to a three-way valve 20 controlled by a solenoid 22. In a cooling operation, the hot gas is passed through the condenser 24 where it condenses and flows to the receiver 26 and then through line 28, heat exchanger 30, and line 32 to the expansion device 34. The liquid refrigerant expands through the device 34 into line 36, to distributor 38 and into the refrigerant coil 40 which functions as a refrigerant evaporator during the cooling mode of operation of the system.

The gaseous refrigerant leaves the evaporator through line 42, passes through heat exchanger 30 and into the accumulator 44 from whence it passes back through suction line 46 to the compressor 14.

In a heating and in a defrosting operation, the pilot solenoid 22 is energized to move the three-way valve 20 to an opposite position so that the hot gas is discharged into line 48 which branches into line 50 leading to a defrost pan heater 52 and another line 54 leading to the receiver 26 through a check valve.

The hot gas exiting the defrost pan heater passes through line 56 which joins line 36 between the expansion device 34 and the distributor 38. Thus, in both a heating mode and a defrosting operation, the refrigerant being fed to the coil 40 does not pass through an expansion device. The return of the refrigerant from the coil 40 in a heating mode is in the same way as was described in connection with a cooling mode. A relatively small amount of liquid from the receiver 26 is forced through the line 28 and to the upstream side of the expansion device 34, in the same manner as during the cooling operation, but this liquid is effectively not expanded in the expansion device but passes through either a notch in the seat of the expansion valve or a small metering hole in the body of the expansion valve.

The description thus far has been of one conventional type of transport refrigeration system.

Now, in accordance with the invention, a first temperature sensor 58 is provided in heat exchange relation with the line 32 to sense the temperature of the fluid passing through the line to the expansion valve 34. A second temperature sensor 60 is provided in heat exchange relation with some line or structure to sense the fluid temperature in that portion of the system which is downstream of the expansion valve, and is downstream of the location at which line 56 would feed hot gas to the refrigerant coil in a heating operation, but is upstream of the evaporator 40.

As shown in FIG. 1, the currently preferred location for the second sensor 60 is believed to be at one of the distributor tubes 38*a* and relatively close to its end which joins the evaporator. This is because at this location the refrigerant has typically had a greater temperature drop in its more nearly full expansion in a cooling operation, and thus there is a greater temperature difference between the first and second sensor than if the second sensor were located slightly upstream of the distributor header 38. However, the invention can be carried out with the second sensor so located.

The temperature sensors 58 and 60 may take any of various forms including that of a thermistor (which has a negative temperature coefficient), or of a positive temperature coefficient resistor, for example. In any case, the temperature sensors are tightly clamped on the lines as is conventional with such sensors and will reflect through the line temperature the temperature of whatever fluid is in the line. While not shown, to promote the sensitivity of the sensors and isolate them from local ambient air temperatures, thermal insulation preferably would encase the sensors and lines at their locations.

Figure 2:
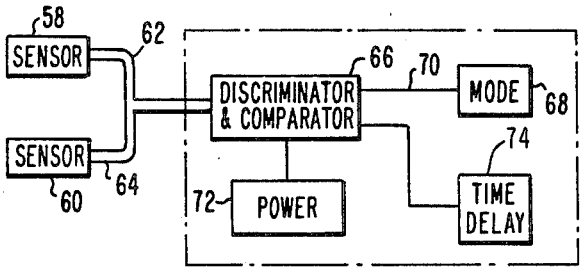
FIG. 2 is a block diagram of a control system for carrying out the invention.

A control arrangement for utilizing the signals generated by the sensors 58 and 60 is illustrated in FIG. 2 and includes the two noted sensors which feed electrical signals through lines 62 and 64 to the discriminator and comparator 66. Additionally, the mode of compressor operation, that is, either heating or cooling, is fed from module 68 through line 70 to the module 66.

The module 66 receives the signals reflecting the temperatures sensed by the sensors 58 and 60. Its function is to compare the difference in temperatures to determine whether there is a departure in differential temperature from the predetermined ranges of differential temperatures normally expected in accordance with the operating modes of the system. Accordingly, the module 66 also discriminates between these different modes of operation. Should the departure in differential temperature be such as to indicate a problem with loss of refrigerant charge, the comparator and discriminator module provides a signal to a power control element 72 for at least signalling the desirability of a system shut-down and, preferably, automatically shutting the system down.

Since in changing from one operating mode to another, there is a reversal of temperatures at the sensors and a period of time is required to obtain stabilization of the system in the new operating mode, it is considered preferable that a time delay device 74 (FIG. 2) also be provided and connected so that the means for effecting the shut-down is rendered inoperative for a period adequate to permit the system to restabilize in the new mode of operation. The same time delay arrangement can also be used to permit continued compressor operation for some minimum period at a low charge so that any nuisance shut-downs from short flow interruptions occurring with expansion device hunting are avoided.

OPERATION

In a cooling operation, relatively hot liquid refrigerant passes through line 32 to the expansion device 34 with the first means 58 sensing this relatively high temperature. However, line 38*a* will reflect a much lower refrigerant temperature because the refrigerant in expanding through the expansion device and distributor drops significantly in temperature. Accordingly, in a cooling operation, the temperature differential with a normal or adequate charge of refrigerant in the system will be in a range in which the first sensor means is significantly hotter than the second sensor means.

Should a leak develop in the system, with significant loss of refrigerant charge, and irrespective of whether the leak is on the high or low pressure side of the system, the differential temperature between the two sensors will decrease significantly so that the sensed temperatures are relatively close or equal. Thus, the control system responding to the drop of the differential temperature below the range normally expected in the cooling operation will at least signal a shut-down and preferably accomplish it.

In a heating mode of operation, the temperature differential is reversed in the sense that the temperature sensed by the second means 60 should be considerably hotter than that sensed by the first means 58, with an adequate charge of refrigerant. This reversal stems from the hot gas leaving the heater drain pan 52 passing through line 56 and into line 36 without passage through any expansion device. While there is typically some minor flow of refrigerant through the line 32 from the receiver 26 as described before, this refrigerant will be significantly cooler than the hot gas passing directly into line 36. Thus, the temperature differential between the two sensors 58 and 60 will have reversed with respect to the cooling mode of operation.

With a loss of refrigerant on the high pressure side in a heating operation, the temperature sensed by the second sensor 60 will drop and come relatively close to the temperature sensed by the first sensor 58. In other words, the differential temperature between the sensors will depart from the predetermined range expected in a heating operation with a normal charge. Accordingly, a signal will be generated for a shut-down.

It is a somewhat different matter in a heating operation in which the leak may occur on the low side of the system. In such a case, the refrigerant will be pumped out until the suction pressure reaches approximately atmospheric in which case some air can be drawn into the suction side and mixed with whatever refrigerant is left in the system. This pumped air is, of course, heated as it is compressed and depending upon the extent of the leak, there may be instances where the sensed temperature by the second sensor will remain sufficiently above that of the first sensor that a shut-down signal is not generated within a relatively short time. However, with transport refrigeration systems which have the capability of providing both heating and cooling, their usual operation is to switch back and forth from each of these modes as the temperature of the served space alternates between temperatures above and below the thermostat setpoint. Thus, the system, if in a heating mode will ultimately go back to a cooling mode and then the control will respond as set forth in connection with the cooling operation irrespective of whether the leak is on the high or low side.

In that connection, it is to be appreciated that the compressors can safely run for at least some significant period, such as from a half hour to an hour, without refrigerant since the compressor failure stems not from the refrigerant loss but rather to the lubrication loss. Thus, while the system can operate for some period with air, the air is not as miscible with oil as refrigerant and ultimately the oil carried out into the system will tend to be stored and not returned to the compressor. Thus, it is desirable that a shut-down occur within a given time after the charge has dropped to an inadequate level.

I claim:

1. In a transport refrigeration system adapted to operate selectively in either a cooling or heating mode by feeding a refrigerant coil in the served space, said system including an expansion device located upstream from both said refrigerant coil and the location at which hot gas refrigerant is introduced into a line to feed said refrigerant coil for heating, a refrigerant loss control arrangement, comprising:

first means for sensing the temperature of fluid fed to said expansion device;

second means for sensing the temperature of fluid downstream of both said expansion device and said location for hot refrigerant introduction, and upstream of said refrigerant coil;

means responsive to the operating mode of the system and the differentials in temperature sensed by said first and second means for at least signalling the desirability of a system shut-down in accordance with a departure in differential temperatures from predetermined ranges of differential temperatures normally expected in accordance with the operating mode of the system under an adequate charge condition.

2. In a system according to claim 1 wherein:

said responsive means provides said signal under conditions in which differences in sensed temperatures between the first and second means is less than normally expected, irrespective of whether the operating mode of the system is heating or cooling.

3. A system according to claim 2 wherein:

said responsive means responds to an operating mode of heat to provide said signal when said sensed temperature of said second sensor fails to fall in a temperature range above the sensed temperature of said first sensor by at least a predetermined value, and responds to an operating mode of cooling to provide said signal when said sensed temperature of said second sensor fails to fall in a temperature range below the sensed temperature of said first sensor by at least another predetermined value.

4. A system according to claim 1 including:

time-delay means operative upon a change in operating mode to render said responsive means inoperative to provide a shut-down signal for a period adequate to permit said system to restabilize in the other mode of operation.

5. A system according to claim 1 including:

a refrigerant distributor upstream of said refrigerant coil; and said second means is located in heat exchange relation with a tube of said distributor.

6. The method of detecting a refrigerant charge loss in a transport refrigeration system of the type adapted to operate selectively in either a heating or cooling mode, and which includes a refrigerant coil in the served space, an expansion device located upstream from both the refrigerant coil and the location at which hot gas refrigerant is introduced to feed the coil in a heating mode comprising:

sensing the temperature of fluid fed to said expansion device;

sensing the temperature of fluid downstream of both the expansion device and said location for hot gas introduction, but upstream of said refrigerant coil;

determining the differential in temperatures sensed at the two locations;

determining the departures in differential temperatures from the ranges of differential temperatures normally expected with an adequate refrigerant charge, and in accordance with the operating mode of the system; and at least signaling the desirability of a shut-down of said system in accordance with a determination of departures falling outside the expected ranges of differentials.

7. The method of claim 6 including:

delaying the signalling of the desirability of a shut-down for a predetermined time following a change in operating mode of the system to permit restabilization of the system in the new operating mode.

* * * * *